US011772148B2

(12) United States Patent
Yamauchi

(10) Patent No.: US 11,772,148 B2
(45) Date of Patent: Oct. 3, 2023

(54) FORMING SYSTEM

(71) Applicant: SUMITOMO HEAVY INDUSTRIES, LTD., Tokyo (JP)

(72) Inventor: Kei Yamauchi, Ehime (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 101 days.

(21) Appl. No.: 17/391,771

(22) Filed: Aug. 2, 2021

(65) Prior Publication Data

US 2021/0354187 A1 Nov. 18, 2021

Related U.S. Application Data

(63) Continuation of application No. PCT/JP2020/008886, filed on Mar. 3, 2020.

(30) Foreign Application Priority Data

Apr. 22, 2019 (JP) ..... 2019-080796

(51) Int. Cl.

| | |
|---|---|
| ***B21D 26/00*** | (2006.01) |
| ***B21D 26/041*** | (2011.01) |
| ***B21D 26/047*** | (2011.01) |
| ***B21D 37/16*** | (2006.01) |

(52) U.S. Cl.

CPC ..... *B21D 26/041* (2013.01); *B21D 26/047* (2013.01); *B21D 37/16* (2013.01)

(58) Field of Classification Search

CPC ... B21D 26/041; B21D 26/047; B21D 26/033
See application file for complete search history.

(56) References Cited

U.S. PATENT DOCUMENTS

| | | | |
|---|---|---|---|
| 8,171,769 B2 | 5/2012 | Barthelemy et al. | |
| 10,040,110 B2 | 8/2018 | Ishizuka et al. | |
| 10,967,414 B2 | 4/2021 | Salka et al. | |
| 2018/0221933 A1* | 8/2018 | Saika | B21D 26/033 |

FOREIGN PATENT DOCUMENTS

| | | |
|---|---|---|
| JP | 2005-009466 A | 1/2005 |
| JP | 2006-000922 A | 1/2006 |
| JP | 2008-006463 A | 1/2008 |
| JP | 2016-002578 A | 1/2016 |
| JP | 2016-190252 A | 11/2016 |
| JP | 2018-167315 A | 11/2018 |
| WO | 2017-038692 A1 | 3/2017 |

OTHER PUBLICATIONS

International Search Report issued in Application No. PCT/JP2020/008886, dated Apr. 7, 2020.
Office Action issued in Canadian Application No. 3,127,032, dated Apr. 6, 2023.

* cited by examiner

*Primary Examiner* — Debra M Sullivan
(74) *Attorney, Agent, or Firm* — Michael Best & Friedrich LLP

(57) ABSTRACT

Provided is a forming system that expands a heated metal pipe material to form a metal pipe. The forming system includes a gas supply portion that supplies a gas to the heated metal pipe material to expand the metal pipe material, a nozzle that includes a feed port for supplying the gas, a discharge portion that discharges the gas after expanding the metal pipe material, and a cooling unit that cools the gas flowing through the discharge portion and is provided in the nozzle.

12 Claims, 4 Drawing Sheets

FORMING SYSTEM

RELATED APPLICATIONS

The contents of Japanese Patent Application No. 2019-080796, and of International Patent Application No. PCT/JP2020/008886, on the basis of each of which priority benefits are claimed in an accompanying application data sheet, are in their entirety incorporated herein by reference.

BACKGROUND

Technical Field

A certain embodiment of the present disclosure relates to a forming system.

Description of Related Art

In the related art, a forming system capable of improving a sealing property when supplying a fluid to a metal pipe material is described. The forming system includes a heating unit for heating an end portion of the metal pipe material, a fluid supply unit for supplying a fluid to the metal pipe material to expand the metal pipe material, and a control unit for controlling the heating unit and the fluid supply unit. The control unit controls the heating unit so as to heat the end portion of the metal pipe material before the fluid is supplied by the fluid supply unit.

SUMMARY

According to an aspect of the present disclosure, there is provided is a forming system that expands a heated metal pipe material to form a metal pipe. According to an embodiment of the present invention, there is provided a forming system that expands a heated metal pipe material to form a metal pipe, the system including a gas supply portion that supplies a gas to the heated metal pipe material to expand the metal pipe material, a nozzle that includes a feed port for supplying the gas, a discharge portion that discharges the gas after expanding the metal pipe material, and a cooling unit that cools the gas flowing through the discharge portion and is provided in the nozzle.

DETAILED DESCRIPTION

Figure 1:
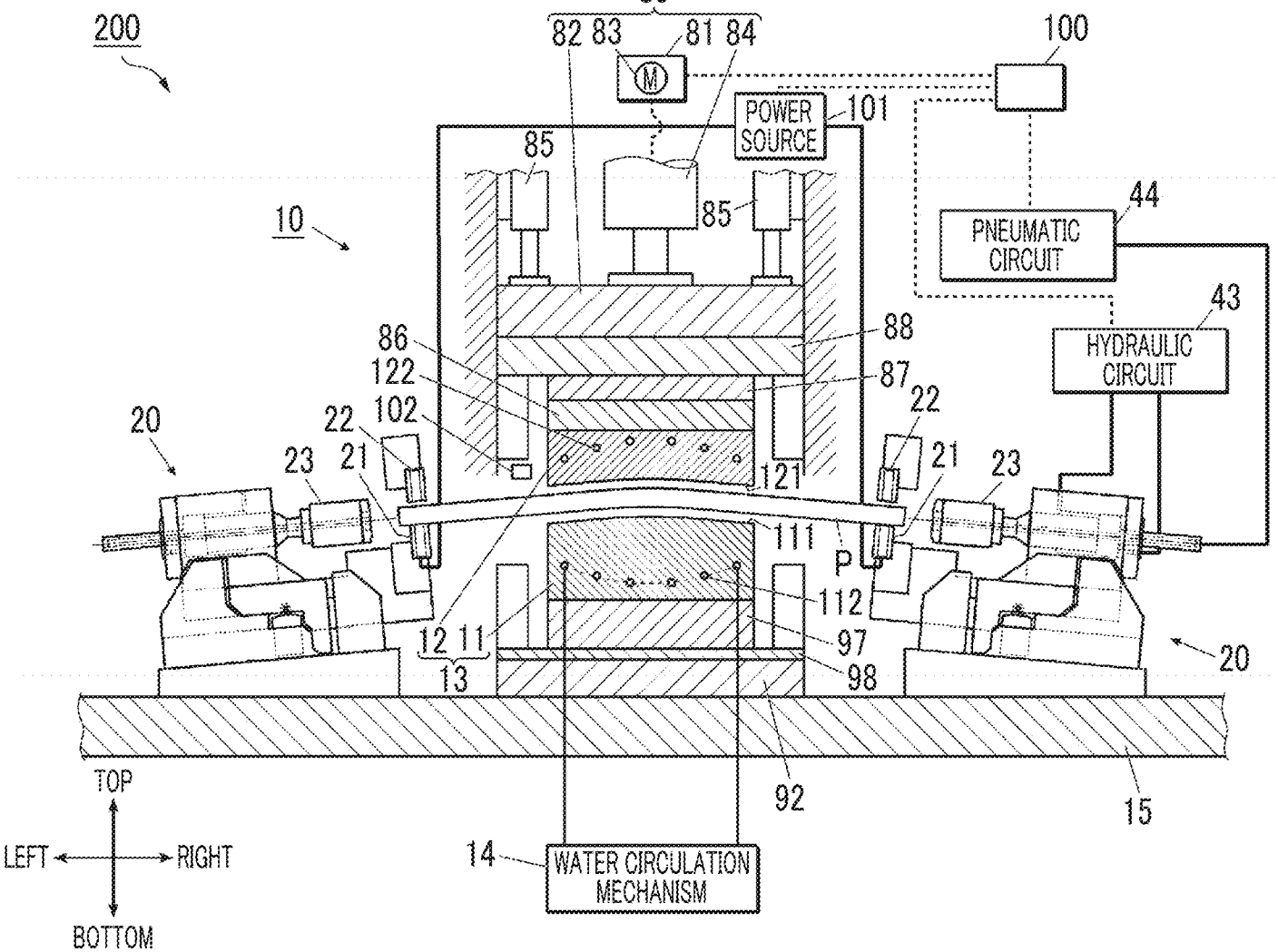
FIG. 1 is a schematic view of an expansion forming apparatus included in a forming system according to a present embodiment.

In the forming system described in the related art, the gas supplied to the metal pipe material becomes hot as the metal pipe material is heated. When the high-temperature gas is released after the forming of the metal pipe material in the forming system is completed, a member around a flow path through which the fluid flows may be affected by heat.

It is desirable to provide a forming system capable of suppressing an influence of heat on the member around the flow path.

In this forming system, the gas is supplied to the heated metal pipe material by the gas supply portion to expand the metal pipe material. The gas becomes a high-temperature gas due to the heated metal pipe material. The high-temperature gas is discharged at a discharge portion after expanding the metal pipe material. Here, the forming system includes a cooling unit that cools the gas flowing through the discharge portion. This makes it possible to prevent the hot fluid from flowing through the flow path in the forming system. From the above, an influence of heat on a member around the flow path can be suppressed.

The gas supply portion may include a support portion extending from the nozzle to an opposite side of the feed port to support the nozzle, and a drive unit that moves the support portion along an extending direction of the support portion, a flow path extending so as to cause the gas to flow to a feed port side and cause the high-temperature gas to flow from the metal pipe material to a discharge portion side may be formed in the nozzle and the support portion, the gas supply portion may be provided with a cooling unit that cools the high-temperature gas flowing through the flow path, and the cooling unit may be provided as a member separate from the nozzle at least at a position on the feed port side in the extending direction with respect to the drive unit.

In this forming system, a high-pressure gas is supplied to the heated metal pipe material by the gas supply portion to expand the metal pipe material. The high-pressure gas becomes a high-temperature gas due to the heated metal pipe material. The high-temperature gas flows through the flow path provided in the nozzle and the support portion. The cooling unit is disposed so as to cool the flow path at least at a position on the feed port side in the extending direction with respect to the drive unit. Therefore, the high-temperature gas flowing through the flow path is cooled by the cooling unit at least at a position on the feed port side in the extending direction with respect to the drive unit. At least a range on the feed port side in the extending direction with respect to the drive unit is less susceptible to heat as compared with the drive unit and a range on an opposite side of the feed port side in the extending direction with respect to the drive unit, so that the influence of heat due to the high-temperature gas can be suppressed within the range. Therefore, the influence of heat on the member around the flow path can be suppressed.

The gas supply portion may include a support portion extending from the nozzle to an opposite side of the feed port to support the nozzle, and a drive unit that moves the support portion along an extending direction of the support portion. A flow path extending so as to cause the gas to flow to a feed port side and cause the gas to flow from the metal pipe material to a discharge portion side may be formed in the nozzle and the support portion, the gas supply portion may be provided with a cooling unit that cools the gas flowing through the flow path, and the cooling unit may be provided at least at a position on the feed port side in the extending direction with respect to the drive unit and may cool the high-temperature gas by reducing a cross-sectional area of a section of a part of the flow path with respect to the extending direction as compared with a cross-sectional area of the other section of the flow path with respect to the extending direction.

In this forming system, a high-pressure gas is supplied to the heated metal pipe material by the gas supply portion to expand the metal pipe material. The high-pressure gas becomes a high-temperature gas due to the heated metal pipe material. The high-temperature gas flows through the flow path provided in the nozzle and the support portion. In the cooling unit provided in the flow path at least at a position on the feed port side in the extending direction with respect to the drive unit, a section of a part of the flowpath is reduced. The high-temperature gas flowing through the flow path undergoes an adiabatic change by passing through the cooling unit. Therefore, the high-temperature gas is cooled at least at the position on the feed port side in the extending direction with respect to the drive unit. At least a range on the feed port side in the extending direction with respect to the drive unit is less susceptible to heat as compared with the drive unit and a range on an opposite side of the feed port side in the extending direction with respect to the drive unit, so that the influence of heat due to the high-temperature gas can be suppressed within the range. Therefore, it is possible to efficiency suppress the influence of heat on the member around the flow path with a simple configuration.

Hereinafter, embodiments of the present disclosure will be described in detail with reference to the drawings. Note that in the following description, the same or equivalent elements will be denoted by the same reference symbols, and the redundant description thereof will be omitted. The dimensional ratios in the drawings do not always match those described.

Overview of Expansion Forming Apparatus

FIG. 1 is a schematic view of an expansion forming apparatus included in the forming system according to the present embodiment. As shown in FIG. 1, a forming system 200 includes an expansion forming apparatus 10 that forms a metal pipe by blow forming. The expansion forming apparatus 10 is installed on a horizontal plane. Then, the vertical upper side with respect to the horizontal plane on which the expansion forming apparatus 10 is installed is referred to as "top", the vertical lower side is referred to as "bottom", one side in one direction parallel to the horizontal plane (the left side on the paper surface of FIG. 1) is referred to as "left", and the opposite side (the right side on the paper surface of FIG. 1) is referred to as "right". Further, the front side which is perpendicular to the paper surface of FIG. 1 is referred to as "front" and the back side is referred to as "rear". The terms "top," "bottom," "left," and "right" are based on the states shown and are for convenience.

The expansion forming apparatus 10 includes a die 13 composed of a lower die 11 and an upper die 12 which are paired with each other, an upper die drive mechanism 80 that moves the upper die 12, a pair of pipe holding mechanisms 20 that respectively hold a right end portion and a left end portion of a metal pipe material P on both the right and left sides with the lower die 11 and the upper die 12 interposed therebetween, a water circulation mechanism 14 that forcibly cools the die 13 with water, a control device 100 that controls each of the above configurations, and a base stage 15 that supports almost the entire configuration of the apparatus on the upper surface. The die 13 is a blow-forming die. Note that the expansion forming apparatus 10 is installed such that the upper surface of the base stage 15 is horizontal.

The lower die 11 is configured with a steel block, has a recessed part 111 provided on the upper surface thereof to correspond to a forming shape, and has a cooling water passage 112 formed in the interior. The upper die 12 is configured with a steel block, has a recessed part 121 provided on the lower surface thereof to correspond to the forming shape, and has a cooling water passage 122 formed in the interior. The water circulation mechanism 14 is connected to the cooling water passages 112 and 122, and cooling water is supplied thereto by a pump.

In a state where the lower die 11 and the upper die 12 are in close contact with each other, the recessed part 111 and the recessed part 121 form a space having a target shape into which the metal pipe material P is to be formed. The target shape is a shape which is curved or bent in the middle with respect to a linear shape parallel to a right-left direction, so that both right and left end portions are inclined downward. The metal pipe material P is bent or curved in the same manner as the target shape. However, the metal pipe material P has an outer diameter smaller than that of the target shape over the entire length, and is formed into the target shape in the process of expansion forming. Therefore, the metal pipe material P is held by the pair of pipe holding mechanisms 20 such that both end portions thereof are directed in the same direction as the target shapes by the lower die 11 and the upper die 12. Specifically, the right end portion of the metal pipe material P is held by the pipe holding mechanism 20 on the right side so as to be inclined slightly downward with respect to the right direction to be directed diagonally downward to the right. Further, the left end portion of the metal pipe material P is held by the pipe holding mechanism 20 on the left side so as to be inclined slightly downward with respect to the left direction to be directed diagonally downward to the left.

A lower die holder 97, a lower die base plate 98, and a slide 92, which are stacked in order downward, are provided on the lower side of the lower die 11.

The upper die drive mechanism 80 includes a first upper die holder 86, a second upper die holder 87, and an upper die base plate 88, which are stacked in order upward from the upper side of the upper die 12. Further, the upper die drive mechanism 80 includes a slide 82 that moves the upper die 12 such that the upper die 12 and the lower die 11 are combined with each other, a pull-back cylinder 85 as an actuator that generates a force for pulling the slide 82 upward, a main cylinder 84 as a drive source for lowering and pressurizing the slide 82, a hydraulic pump 81 that supplies pressure oil to the main cylinder 84, a servomotor 83 that controls the amount of fluid with respect to the hydraulic pump 81, a hydraulic pump (not shown) that supplies pressure oil to the pull-back cylinder 85, and a motor (not shown) that serves as a drive source of the hydraulic pump. The slide 82 is equipped with a position sensor such as a linear sensor for detecting a position in an up-down direction and a movement speed, and a load sensor such as a load cell for detecting the load of the upper die 12.

Note that the position sensor or the load sensor of the upper die drive mechanism 80 is not essential and can be omitted. Further, in a case where hydraulic pressure is used in the upper die drive mechanism 80, a measurement device that measures the hydraulic pressure can be used instead of the load sensor.

Further, the expansion forming apparatus 10 includes a radiation thermometer 102 for measuring the temperature of the metal pipe material P. However, the radiation thermometer 102 is only an example of a temperature detection unit, and a contact type temperature sensor such as a thermocouple may be provided.

The pipe holding mechanism 20 is disposed one on each of the right and left sides of the die 13 on the base stage 15. The pipe holding mechanism 20 on the right side holds one end portion directed diagonally downward to the right, of the metal pipe material P in which the direction thereof is determined by the die 13, and the pipe holding mechanism 20 on the left side holds the other end portion directed diagonally downward to the left, of the metal pipe material P in which the direction thereof is determined by the die 13. The pipe holding mechanism 20 on the right side and the pipe holding mechanism 20 on the left side have the same structure except that the configuration of each of them is fixed on the base stage 15 at an angle adjusted according to the inclination of each of the end portions of the metal pipe material P to be held. Therefore, the following description is mainly performed on the pipe holding mechanism 20 on the right side.

Figure 2:
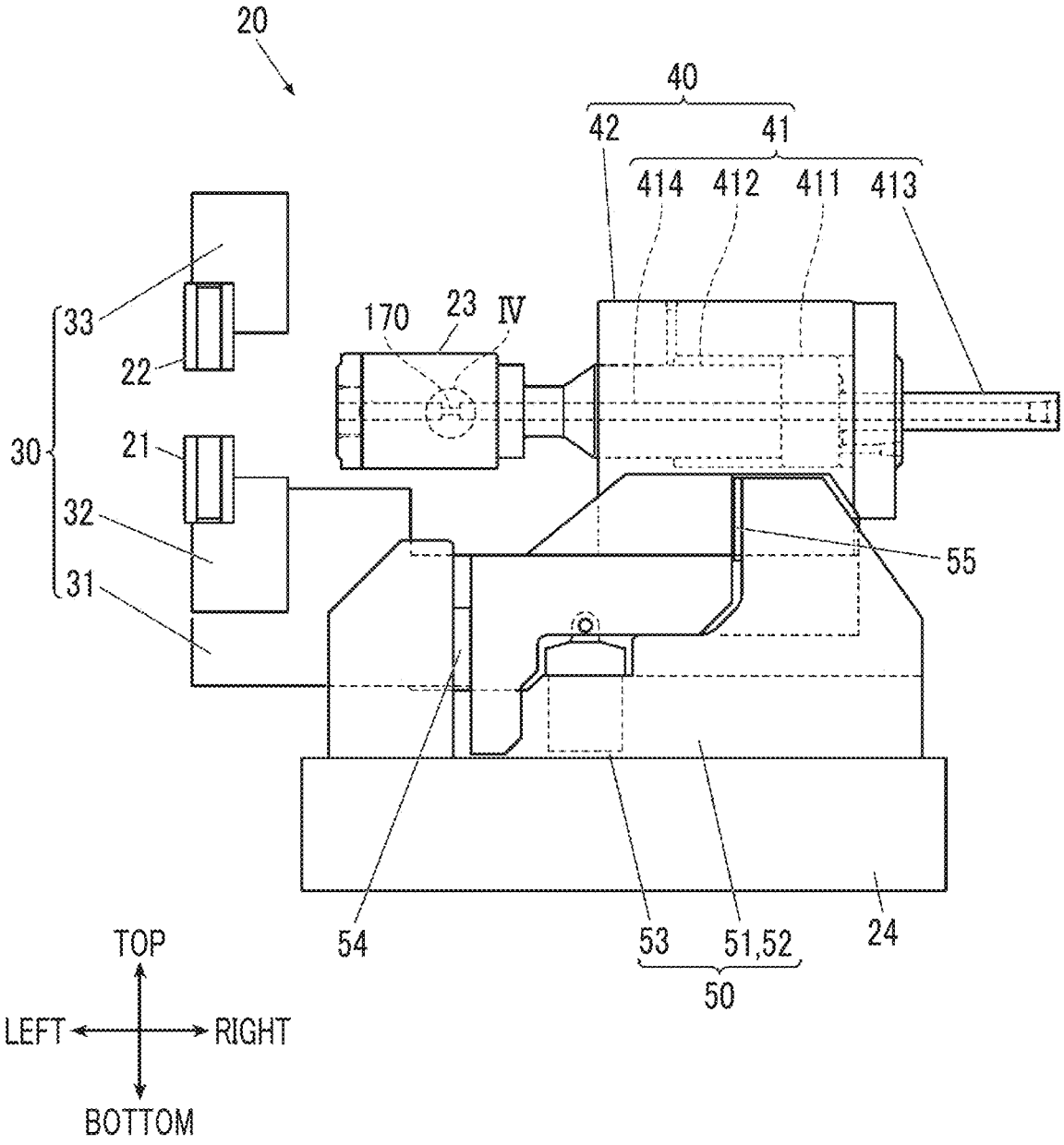
FIG. 2 is a front view of a pipe holding mechanism on a right side shown in FIG. 1.

FIG. 2 is a front view of the pipe holding mechanism on the right side shown in FIG. 1. Note that the pipe holding mechanism 20 on the right side is installed on the upper surface of the base stage 15 in a state where the entire configuration thereof is inclined according to the inclination angle of the right end portion of the metal pipe material P to be held, as described above. However, in FIG. 2, for simplification and clarification of the description, the pipe holding mechanism 20 is shown in a state where the entire configuration thereof is not inclined, that is, in a direction in which the pipe holding mechanism 20 holds the right end portion of the metal pipe material P parallel to the right-left direction.

The pipe holding mechanism 20 includes a lower electrode 21 and an upper electrode 22 which are a pair of electrodes that grips the right end portion of the metal pipe material P, a nozzle 23 that supplies a compressed gas from the right end portion to the inside of the metal pipe material P, the electrode mounting unit 30 that supports the lower electrode 21 and the upper electrode 22, a nozzle mounting unit 40 that supports the nozzle 23, a lifting and lowering mechanism 50 that lifts and lowers the lower electrode 21, the upper electrode 22, and the nozzle 23, and a unit base 24 that supports all of these configurations. The nozzle 23, the nozzle mounting unit 40, a hydraulic circuit 43 described later, and a pneumatic circuit 44 described later are examples of a gas supply portion and a discharge portion.

The unit base 24 is a rectangular plate-shaped block when viewed in a plan view, which supports the electrode mounting unit 30 and the nozzle mounting unit 40 on the upper surface through the lifting and lowering mechanism 50. The unit base 24 can be mounted on and dismounted from the upper surface of the base stage 15, which is a horizontal plane, by fixing means such as a bolt. The pipe holding mechanism 20 has a plurality of unit bases 24 in which the inclination angles of the upper surfaces are different from each other, and by exchanging these unit bases, it is possible to collectively change and regulate the inclination angles of the lower electrode 21, the upper electrode 22, the nozzle 23, the electrode mounting unit 30, the nozzle mounting unit 40, and the lifting and lowering mechanism 50.

Then, in this way, the unit base 24 performs adjustment such that the electrode mounting unit 30 can move the lower electrode 21 and the upper electrode 22 along the extension direction of each end portion of the metal pipe material P having a direction that is defined by the die 13. The "extension direction of an end portion" refers to a direction in which the center line at the one-side end portion of the metal pipe material P linearly extends, or a vector direction along the direction in which the one-side end portion of the metal pipe material P is directed. Further, similarly, the unit base 24 performs adjustment such that the nozzle mounting unit 40 can move the nozzle 23 along the extension direction of each end portion of the metal pipe material P having a direction that is defined by the die 13. That is, the unit base 24 functions as an electrode adjusting unit and a nozzle adjusting unit.

As described above, in a case where the extension direction of the center line of the right end portion of the metal pipe material P which is defined by the die 13 is a direction diagonally downward to the right (there is no inclination in the front-rear direction), the upper surface of the unit base 24 is an inclined surface inclined in the direction in which the right side is lowered with respect to the horizontal plane around an axis along the front-rear direction, and the inclination angle thereof coincides with the inclination angle of the extension direction of the right end portion of the metal pipe material P.

The lifting and lowering mechanism 50 includes a pair of front and rear lifting and lowering frame bases 51 and 52 which are mounted on the upper surface of the unit base 24, and a lifting and lowering actuator 53 that imparts a lifting and lowering motion to a lifting and lowering frame 31 of the electrode mounting unit 30, which is supported by the lifting and lowering frame bases 51 and 52 so as to be able to move up and down along the direction perpendicular to the upper surface of the unit base 24.

The lifting and lowering frame bases 51 and 52 are detachably mounted on the upper surface of the unit base 24 by fastening means such as a bolt. Then, the lifting and lowering frame base 51 on the front side and the lifting and lowering frame base 52 on the rear side have three-dimensional shapes which are plane-symmetrical with a plane parallel to the up-down direction and the right-left direction as a symmetrical plane. The lifting and lowering frame bases 51 and 52 each have a frame shape and support the lifting and lowering frame 31 between them such that it can move up and down along the direction perpendicular to the upper surface of the unit base 24. Further, both the lifting and lowering frame bases 51 and 52 have plate-shaped liners 54 and 55 on the left side and the right side, and plate-shaped liners on the front side and the rear side. The liners 54 and 55 stably guide a lifting and lowering motion along the direction perpendicular to the upper surface of the unit base 24 with respect to the front-side portion and the rear-side portion of the lifting and lowering frame 31. In addition, the liners provided on the front side and the rear side stably guide a motion in the right-left direction.

Further, the lifting and lowering actuator 53 is a direct acting type actuator that imparts a reciprocating motion along the direction perpendicular to the upper surface of the unit base 24 to the lifting and lowering frame 31, and for example, a hydraulic cylinder or the like can be used.

Each of the lower electrode 21 and the upper electrode 22 is a rectangular plate-shaped electrode in which a plate-shaped conductor is sandwiched between insulating plates. A semicircular cutout is formed in each of the upper end portion at the center of the lower electrode 21 and the lower end portion at the center of the upper electrode 22 so as to perpendicularly penetrate the flat plate surface. Then, when the lower electrode 21 and the upper electrode 22 are disposed on the same plane and the upper end portion of the lower electrode 21 and the lower end portion of the upper electrode 22 are brought into close contact with each other, the semicircular cutouts are combined to form a circular through-hole. This circular through-hole substantially coincides with the outer diameter of the end portion of the metal pipe material P, and when the metal pipe material P is energized, the end portion thereof is gripped by the lower electrode 21 and the upper electrode 22 in a state of being fitted into the circular through-hole.

Further, the lower electrode 21 is electrically connected to a power source 101 that is controlled by the control device 100. The upper electrode 22 energizes the metal pipe material P through the lower electrode 21. The power source 101 is controlled by the control device 100 to energize the lower electrodes 21 of the right and left pipe holding mechanisms 20, and can rapidly heat the metal pipe material P by Joule heating.

The outer shape of the end portion of the metal pipe material P is not limited to a circular shape. Therefore, the cutout of each of the lower electrode 21 and the upper electrode 22 has a shape obtained by halving the outer shape of the end portion of the metal pipe material P.

The electrode mounting unit 30 supports the lower electrode 21 and the upper electrode 22 while maintaining the direction in which the flat plate surfaces of the lower electrode 21 and the upper electrode 22 are perpendicular to the extension direction of the right end portion of the metal pipe material P described above. For example, in a case where the upper surface of the unit base 24 is horizontal, the electrode mounting unit 30 supports the lower electrode 21 and the upper electrode 22 in the direction in which the flat plate surfaces of the lower electrode 21 and the upper electrode 22 become parallel in the up-down direction and the front-rear direction.

The electrode mounting unit 30 includes the lifting and lowering frame 31 that is subjected to the lifting and lowering motion along the direction perpendicular to the upper surface of the unit base 24 by the lifting and lowering mechanism 50 described above, a lower electrode frame 32 that holds the lower electrode 21 at the left end portion of the lifting and lowering frame 31, and an upper electrode frame 33 that is provided above the lower electrode frame 32 and holds the upper electrode 22.

The lower electrode frame 32 is a frame body that holds the outer periphery excluding the upper end portion of the lower electrode 21. The lower electrode frame 32 is supported by the left end portion of the lifting and lowering frame 31 so as to be movable along the direction parallel to the right-left direction when viewed in a plan view and parallel to the upper surface of the unit base 24 through two linear guides provided at the front and the rear. Further, the lower electrode frame 32 is provided with a lower electrode movement actuator, which imparts a moving motion along the moving direction by each linear guide. For the lower electrode movement actuator, for example, a hydraulic cylinder or the like can be used. The lower electrode frame 32 is provided with a position sensor such as a linear sensor that detects a position in the moving direction by each linear guide. With these configurations, the lower electrode 21 can reciprocate along the extension direction of the right end portion of the metal pipe material P.

Slide blocks that are movable along the direction parallel to the right-left direction when viewed in a plan view and parallel to the upper surface of the unit base 24 are individually provided on the upper surfaces of the front end portion and the rear end portion of the lower electrode frame 32 through linear guides. Further, the slide block is provided with an upper electrode movement actuator as a one-side electrode movement actuator that imparts a moving motion along the moving direction by each linear guide. For the upper electrode movement actuator, for example, a hydraulic cylinder or the like can be used. The slide block is provided with a position sensor such as a linear sensor that detects a position in the moving direction by each linear guide.

The upper electrode frame 33 is a frame body that holds the outer periphery excluding the lower end portion of the upper electrode 22. The upper electrode frames 33 is supported by each slide block so as to be movable along the direction perpendicular to the upper surface of the unit base 24 through linear guides provided two by two at the front and the rear at the upper portion of each slide block. Further, an upper electrode levitation spring is interposed between the upper electrode frame 33 and each slide block, and thus the upper electrode frame 33 is always pressed upward with respect to each slide block.

The upper electrode frame 33 is movable in the direction (the up-down direction) perpendicular to the upper surface of the unit base 24 with respect to each slide block. Then, each slide block is movable in the direction (the right-left direction) parallel to the right-left direction when viewed in a plan view and parallel to the upper surface of the unit base 24 with respect to the lower electrode frame 32. Therefore, the upper electrode frame 33 is able to move up and down with respect to the lower electrode frame 32 and is movable along the extension direction (the right-left direction) of the end portion of the metal pipe material P.

Then, clamp actuators for lifting and lowering the upper electrode frame 33 along the direction perpendicular to the upper surface of the unit base 24 are provided one by one at the front and the rear at the lower electrode frame 32. For each clamp actuator, for example, a hydraulic cylinder or the like can be used. A tip portion of a plunger of each clamp actuator is connected to the upper electrode frame 33 so as to be movable along the extension direction (the right-left direction) of the end portion of the metal pipe material P. Therefore, the moving motion of the upper electrode frame 33 with respect to the lower electrode frame 32 along the extension direction (the right-left direction) of the end portion of the metal pipe material P is not hindered.

The nozzle 23 is a cylinder into which the end portion of the metal pipe material P can be inserted. The center line of the nozzle 23 is supported by the nozzle mounting unit 40 so as to be parallel to the extension direction of the end portion of the metal pipe material P. The inner diameter of the end portion of the nozzle 23 on the metal pipe material P side (hereinafter, referred to as "feed port") substantially coincides with the outer diameter of the metal pipe material P after expansion forming. The nozzle 23 is provided with a pressing force sensor that detects the pressing force of the contact of the metal pipe material P.

The nozzle mounting unit 40 is mounted on the right end portion of the lifting and lowering frame 31 of the electrode mounting unit 30. Therefore, in a case where the lifting and lowering motion by the lifting and lowering mechanism 50 is performed, the nozzle mounting unit 40 moves up and down integrally with the electrode mounting unit 30. The nozzle mounting unit 40 supports the nozzle 23 at a position where the end portion of the metal pipe material P and the nozzle 23 become concentric, in a state where the lower electrode 21 and the upper electrode 22 of the electrode mounting unit 30 grip the end portion of the metal pipe material P. For example, in a case where the upper surface of the unit base 24 is horizontal, the nozzle mounting unit 40 supports the nozzle 23 in the direction in which the center line of the nozzle 23 is parallel to the right-left direction.

The nozzle mounting unit 40 has a hydraulic cylinder mechanism as a nozzle movement actuator that moves the nozzle 23 along the extension direction of the end portion of the metal pipe material P. This hydraulic cylinder mechanism is provided with a piston 41 (an example of a support portion) that holds the nozzle 23, and a cylinder 42 (an example of a drive unit) that imparts an advancing and retreating movement to the piston 41. The cylinder 42 is fixedly mounted on the right end portion of the lifting and lowering frame 31 in the direction in which the piston 41 advances and retreats in parallel with the extension direction of the end portion of the metal pipe material P. The cylinder 42 is connected to a hydraulic circuit 43 (refer to FIG. 1), and pressure oil, which is a working fluid, is supplied to and discharged from the inside thereof. In the hydraulic circuit 43, the supply and discharge of the pressure oil to and from the cylinder 42 is controlled by the control device 100. The hydraulic circuit 43 is also connected to the pipe holding mechanism 20 on the left side. However, a path showing the connection is not shown in FIG. 1.

The piston 41 is provided with a main body 411 stored in the cylinder 42, a head portion 412 protruding from the left end portion (the lower electrode 21 and upper electrode 22 side) of the cylinder 42 to the outside, and a tubular portion 413 protruding from the right end portion of the cylinder 42 to the outside. The main body 411, the head portion 412, and the tubular portion 413 each have a cylindrical shape and are concentrically and integrally formed. The outer diameter of the main body 411 substantially coincides with the inner diameter of the cylinder 42. Then, in the cylinder 42, hydraulic pressure is supplied to both sides of the main body 411 to advance and retreat the piston 41.

The head portion 412 has a diameter smaller than the main body 411, and the nozzle 23 is concentrically and fixedly mounted on the tip portion on the left side (the lower electrode 21 and upper electrode 22 side) of the head portion 412. The tubular portion 413 is a circular tube having a diameter smaller than the main body 411 and the head portion 412. The tubular portion 413 penetrates the right end portion of the cylinder 42 and protrudes to the outside of the cylinder 42.

The piston 41 is formed with a compressed gas flow path 414 that penetrates the center over the entire length from the head portion 412 to the tip of the tubular portion 413 through the main body 411. Then, the tip portion (right end portion) of the tubular portion 413 is connected to a pneumatic circuit 44 (refer to FIG. 1) that supplies and discharges a compressed gas to and from the nozzle 23. The pneumatic circuit 44 is also connected to the pipe holding mechanism 20 on the left side. However, a path showing the connection is not shown in FIG. 1. Further, the nozzle 23 provided at the tip portion of the head portion 412 communicates with the compressed gas flow path 414. That is, the nozzle mounting unit 40 has a structure capable of supplying the compressed gas to the nozzle 23 through the piston 41 from the side opposite to the nozzle 23. The compressed gas is, for example, compressed air.

Forming Method of Metal Pipe with Expansion Forming Apparatus

The expansion forming operation of the expansion forming apparatus 10 having the above configuration is performed based on the operation control of the control device 100. Then, the control device 100 includes a storage unit that stores a processing program and various types of information related to the operation control, and a processing device that executes the operation control, based on the processing program.

First, the unit base 24 whose upper surface is inclined in the direction corresponding to the extension direction of the end portion of the metal pipe material P according to the target shape determined by the die 13 is selected and mounted on each pipe holding mechanism 20. Then, each pipe holding mechanism 20 is fixed to the upper surface of the base stage 15.

Then, the control device 100 controls the lower electrode movement actuators of the right and left pipe holding mechanisms 20 to advance the lower electrodes 21 to the positions where they come into contact with the lower die 11. Further, the control device 100 controls the upper electrode movement actuators of the right and left pipe holding mechanisms 20 to retreat the upper electrodes 22 with respect to the lower electrodes 21 to the positions separated from the end portions of the metal pipe material P. The metal pipe material P is placed on the right and left lower electrodes 21 disposed in this way so as to be fitted into the semicircular cutout. Further, since the upper electrode 22 has been retracted, it does not interfere with the work of placing the metal pipe material P. The metal pipe material P placed on the lower electrode 21 is located slightly above the lower die 11 and is not in contact with the lower die 11.

Next, the control device 100 controls the upper electrode movement actuator to move the upper electrode 22 to a gripping position above the lower electrode 21. The gripping position of the upper electrode 22 is the position where the upper electrode 22 is lowered toward the lower electrode 21 side, so that the end portion of the metal pipe material P can be gripped by them.

Next, the control device 100 controls the clamp actuator to lower the upper electrode 22 toward the lower electrode 21. In this way, the end portion of the metal pipe material P is fitted into the semicircular cutout of the upper electrode 22, and is gripped by the lower electrode 21 and the upper electrode 22.

In a state where both end portions of the metal pipe material P are individually gripped by the lower electrodes 21 and the upper electrodes 22 of the right and left pipe holding mechanisms 20, the control device 100 controls the power source 101 to energize the respective lower electrodes 21. In this way, the metal pipe material P is Joule-heated. At this time, the control device 100 monitors the temperature of the metal pipe material P with the radiation thermometer 102 and performs heating for a defined time within a defined target temperature range.

Due to the Joule heating, the metal pipe material P is subjected to thermal expansion, and the end portion thereof extends in the extension direction thereof. The control device 100 stores the correlation between the temperature and the amount of thermal extension of the metal pipe material P as data, and acquires the amount of thermal extension of the metal pipe material P, based on the temperature of the metal pipe material P detected by the radiation thermometer 102, with reference to this correlation data. Further, the control device 100 controls the lower electrode movement actuator from the acquired amount of thermal extension to move the lower electrode 21 and the upper electrode 22 of each pipe holding mechanism 20 to the position where stress is not applied to the metal pipe material P or the position where stress is sufficiently reduced. By performing this electrode position control, the control device 100 functions as an electrode position control unit. This electrode position control is periodically and repeatedly executed while the lower electrodes 21 of the right and left pipe holding mechanisms 20 are being energized.

The electrode position control may perform control in which the lower electrode 21 and the upper electrode 22 move with respect to the end portion of the metal pipe material P while applying a weak tension that does not deform the metal pipe material P in the direction of extending in the extension direction, without using the correlation data between the temperature and the amount of thermal extension of the metal pipe material P. In that case, in a case where the lower electrode movement actuator is, for example, a hydraulic cylinder, the lower electrode 21 and the upper electrode 22 may be moved in the direction of extending in the extension direction with the hydraulic pressure set to the low pressure described above.

When the energization of the metal pipe material P ends, the lower electrode 21 is separated from the lower die 11 by the electrode position control, so that a gap S1 is generated. Therefore, the control device 100 controls the clamp actuator to move the upper electrode 22 up, and further controls the lower electrode movement actuator to bring the lower electrode 21 and the upper electrode 22 closer to the die 13 side and bring the lower electrode 21 into contact with the lower die 11. Then, the upper electrode 22 is moved down to perform gripping again. In this way, the control device 100 functions as a re-gripping operation control unit that performs re-gripping operation control.

Next, the control device 100 controls the lifting and lowering actuator 53 to move the metal pipe material P down to the position where it comes into contact with or approaches the recessed part 111 of the lower die 11. At this time, in a case where the upper surface of the unit base 24 is inclined with respect to the horizontal plane to correspond to the extension direction of the metal pipe material P, when a lowering operation is performed by the lifting and lowering actuator 53, all the configurations on the lifting and lowering frame 31 perform a change in position in the right-left direction. For example, the pipe holding mechanism 20 on the right side moves to the right, and the pipe holding mechanism 20 on the left side moves to the left.

As a result, the lower electrode 21 is separated from the lower die 11 to generate a gap S2. Therefore, the control device 100 controls the clamp actuator to move the upper electrode 22 up, and further controls the lower electrode movement actuator to move the lower electrode 21 and the upper electrode 22 so as to come into contact with the die 13 side. Then, the upper electrode 22 is moved down to grip the end portion of the metal pipe material P again. That is, the control device 100 performs the re-gripping operation control once more.

As described above, the case where the control device 100 performs the re-gripping operation control twice has been exemplified. However, the first re-gripping operation control at the time of the end of energization of the metal pipe material P is not executed, and the re-gripping operation control may be performed only once after the lower electrode 21 and the upper electrode 22 are moved down under the control of the lifting and lowering actuator 53.

Thereafter, the control device 100 controls the servomotor 83 of the upper die drive mechanism 80 to move the upper die 12 down to the position where it comes into contact with the lower die 11. Further, the control device 100 controls the hydraulic circuit 43 to control the nozzle mounting units 40 of the right and left pipe holding mechanisms 20, and advances each nozzle 23 toward each end portion side of the metal pipe material P. As a result, the end portion of the metal pipe material P is inserted into the feed port of the nozzle 23. Then, the control device 100 controls the pneumatic circuit 44 to supply the compressed gas from the nozzle 23 into the metal pipe material P. In this way, the metal pipe material P whose hardness has been lowered due to the Joule heating is formed into the target shape in the die 13 by internal pressure.

On the other hand, the metal pipe material P shrinks as the temperature gradually decreases during the forming, and thus the end portion thereof moves to the die 13 side. The control device 100 stores the correlation between the temperature and the amount of thermal extension of the metal pipe material P as data, as described above, and therefore, the control device 100 acquires the amount of shrinkage of the metal pipe material P, based on the temperature of the metal pipe material P detected by the radiation thermometer 102, with reference to this correlation data. Further, the control device 100 controls the hydraulic circuit 43 from the acquired amount of shrinkage to operate the nozzle mounting unit 40 and move the nozzle 23 to the die 13 side. More specifically, the end portion of the metal pipe material P is moved to follow the amount of shrinkage of the metal pipe material P so as not to come off from the nozzle 23. By performing the nozzle position control, the control device 100 functions as a nozzle position control unit. The nozzle position control is periodically and repeatedly executed while the compressed gas is being supplied from the nozzle 23 into the metal pipe material P.

The nozzle position control may perform control in which an upper limit value is determined in advance within the range where the nozzle 23 does not give the influence of buckling, deformation, or the like to the end portion of the metal pipe material P and the nozzle 23 moves while applying a pressing force so as not to exceed the upper limit value, without using the correlation data between the temperature and the amount of thermal extension of the metal pipe material P.

Then, after the expansion forming is performed on the metal pipe material P by supplying the compressed gas fora certain period of time, the control device 100 stops the supply of the compressed gas, releases the gripping state by the lower electrode 21 and the upper electrode 22, and moves the upper die 12 up. After that, the control device 100 cools the metal pipe material P through the die 13 by the water circulation mechanism 14. Next, the control device 100 discharges a compressed gas (an example of a high-temperature gas) from the inside of the metal pipe material P. After discharging the compressed gas, the control device 100 controls the upper electrode movement actuator of each pipe holding mechanism 20 to retreat the upper electrode 22 in the direction away from the die 13. In this way, the formed metal pipe material P can be easily taken out from the expansion forming apparatus 10.

Configuration of Forming System

Figure 3:
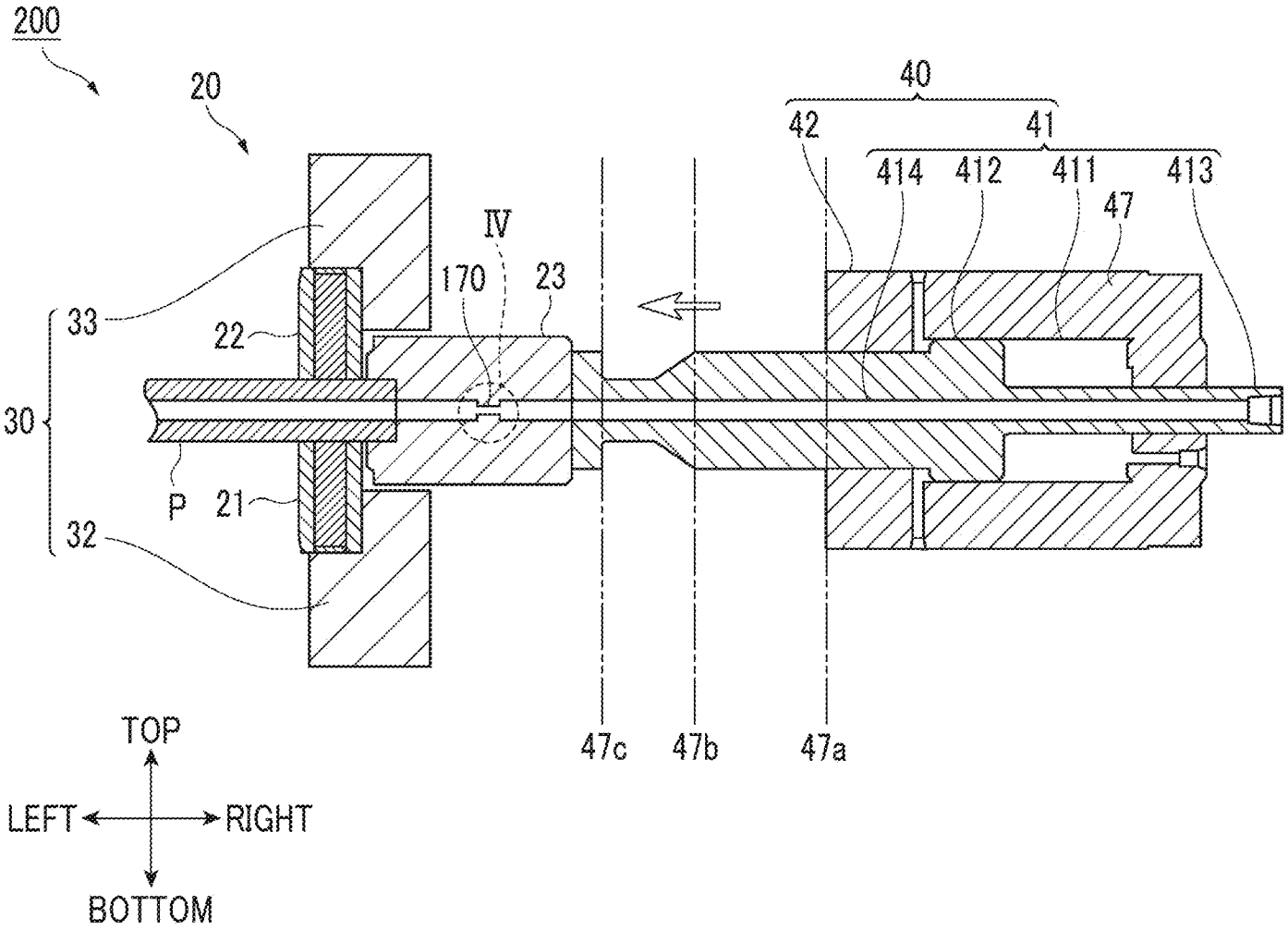
FIG. 3 is a schematic view showing a main portion of a forming system according to a present embodiment.

Next, the forming system 200 according to the present embodiment will be described with reference to FIG. 3. FIG. 3 is a schematic view showing a main portion of the forming system according to the present embodiment. The forming system 200 shown in FIG. 3 includes the expansion forming apparatus 10 having the nozzle 23 for discharging a high-temperature gas from the metal pipe material P, and the nozzle mounting unit 40 and the pneumatic circuit 44 (an example of a gas supply portion and a discharge portion), and a cooling unit 170. The high-temperature gas is, for example, a high-temperature gas in the heated metal pipe material P, and discharged from the metal pipe material P. The high-temperature gas discharged from the metal pipe material P flows through the nozzle 23, the flow path 414 of the nozzle mounting unit 40, and the pneumatic circuit 44 in order, and reaches a discharge port (not shown) in the pneumatic circuit 44.

The pneumatic circuit 44 has, for example, a communication tube having a tip connected to the flow path 414 and communicating with the flowpath 414, an on-off valve provided in the communication tube, and a discharge port located at an end of the communication tube. The communication tube communicates with the flow path 414 and guides the compressed gas from the metal pipe material P to the discharge port. The on-off valve is a valve that opens or closes the communication tube. When the compressed gas is supplied into the metal pipe material P by the control device 100, the control device 100 closes the communication tube by the on-off valve. When the high-temperature gas is discharged from the metal pipe material P, the control device 100 opens the communication tube by the on-off valve. The discharge port discharges the high-temperature gas discharged from the metal pipe material P guided through the communication tube to the outside of the forming system 200. The discharge port is, for example, an exhaust muffler.

The cooling unit 170 cools the high-temperature gas flowing through the flow path 414. The cooling unit 170 is, for example, a member separate from the member included in the nozzle 23 and the nozzle mounting unit 40. Here, as a comparative example with respect to the forming system 200 of the present embodiment, an example in which the cooling unit 170 is excluded from the nozzle 23 and the nozzle mounting unit 40 and composed of only a straight flow path 414 is given. Even in such a comparative example, the high-temperature gas is slightly cooled by heat transfer and heat dissipation in the member around the flow path 414. However, the cooling unit 170 does not include a structure having only the straight flow path 414 as in the comparative example. The cooling unit 170 is a portion having a high cooling capacity for a high-temperature gas as compared with a structure in which cooling is performed only by heat transfer and heat dissipation as in the comparative example. Here, the cooling capacity refers to an ability to increase a difference between the temperature of the high-temperature gas discharged from the metal pipe material P and the temperature of the gas discharged at the discharge port when measured under the same condition. When the control device 100 discharges the high-temperature gas from the metal pipe material P, the cooling unit 170 has a function of cooling the discharged high-temperature gas.

The cooling unit 170 is provided as a separate member from the nozzle 23 and the nozzle mounting unit 40 at least at a position on the feed port side of the nozzle 23 in the extending direction of the flow path 414 with respect to the cylinder 42. That is, in a case where the surface of the cylinder 42 on the nozzle 23 side is a boundary 47*a*, the cooling unit 170 is provided at least at a position on the feed port side of the nozzle 23 in the extending direction of the flow path 414 with respect to the boundary 47*a*. In a case where the piston 41 is pushed most toward the nozzle 23, the cooling unit 170 is provided at least on the feed port side of the nozzle 23 from the main body 411, which is a portion of the piston 41 that comes into contact with the cylinder 42. In this state, the position of the nozzle 23 on the feed port side in the extending direction with respect to the boundary 47*a* corresponds to the "position on the feed port side in the extending direction with respect to the drive unit" in the claim.

Here, by the high-temperature gas flowing through the flow path 414, the heat of the member that has become hot by the heat of the high-temperature gas or the heat transfer by the high-temperature gas may be transferred to the members around the flow path 414, and the members around the flow path 414 may become hot. The nozzle mounting unit 40 has a protected portion 47 that needs to be protected from heat. The protected portion 47 is a portion that has low heat resistance and is affected by the function of supplying the high-pressure gas or exhausting the high-temperature gas when affected by heat. For example, since the cylinder 42 has hydraulic oil in the internal space, the cylinder 42 has, for example, a packing at a portion that comes in contact with the piston 41 in order to suppress the leakage. In the cylinder 42, at least the packing and the internal space having the hydraulic oil are included in the protected portion 47. The protected portion 47 includes a member on the cylinder 42 side in the extending direction of the flow path 414 with respect to the boundary 47*a*. By providing the cooling unit 170 at least at a position on the feed port side of the nozzle 23 in the extending direction of the flow path 414 with respect to the boundary 47*a*, it is possible to prevent the protected portion 47 from becoming hot.

In a case where the position of the piston 41 that comes into contact with the cylinder 42 when the piston 41 is most retracted is set as the boundary 47*b*, the cooling unit 170 may be provided at least on the feed port side of the nozzle 23 with respect to the boundary 47*b*. That is, a region of the piston 41 between the boundary 47*a* and the boundary 47*b* is not a portion directly adjacent to the cylinder 42 during exhaust. However, assuming that the high-temperature gas has passed through the region, the region is heated by heat transfer and is adjacent to the cylinder 42 at the time of retreating. Therefore, in order to further improve the safety, in a case where the region to be heated is kept away from the cylinder 42, the region to be heated may be regarded as a part of the protected portion 47. In this case, the protected portion 47 may be considered to include a member on the cylinder 42 side in the extending direction of the flow path 414 with respect to the boundary 47*b*. Accordingly, the cooling unit 170 can further suppress the temperature rise of the member due to the heat of the high-temperature gas or the heat transfer by the high-temperature gas.

In a case where the piston 41 has a diameter-expanded portion of which a diameter expands near the position where the piston 41 comes into contact with the nozzle 23, the cooling unit 170 may be provided on the nozzle 23 side from the diameter-expanded portion of the piston 41. For example, in a case where a starting point of the piston 41 that expands in diameter toward the diameter-expanded portion on the cylinder 42 side is the boundary 47*c*, the cooling unit 170 may be provided at least on the feed port side of the nozzle 23 with respect to the boundary 47*c*. The region of the piston 41 between the boundary 47*b* and the boundary 47*c* is a portion that is not adjacent to the cylinder 42 even in the retracted state. However, since the region has a small diameter and a small amount of material, compared to the diameter-expanded portion as described above, heat is easily transferred to the cylinder 42 side when the temperature becomes high. Therefore, in order to further improve the safety, a region where heat is easily transferred to the cylinder 42 when the temperature rises may be regarded as a part of the protected portion 47. In this case, the protected portion 47 may be regarded to include a member on the cylinder 42 side in the extending direction of the flow path 414 with respect to the boundary 47*c*. Accordingly, the cooling unit 170 can further suppress the influence of the heat of the member that has become hot by the heat of the high-temperature gas or the heat transfer by the high-temperature gas.

Note that the cooling unit 170 may be provided further on the feed port side of the nozzle 23 from the boundary 47*c*. The cooling unit 170 is provided, for example, near the feed port of the nozzle 23. The farther the cooling unit 170 is from the region corresponding to the protected portion 47, the smaller the influence of the heat transfer, so that the safety can be improved.

Figure 4:
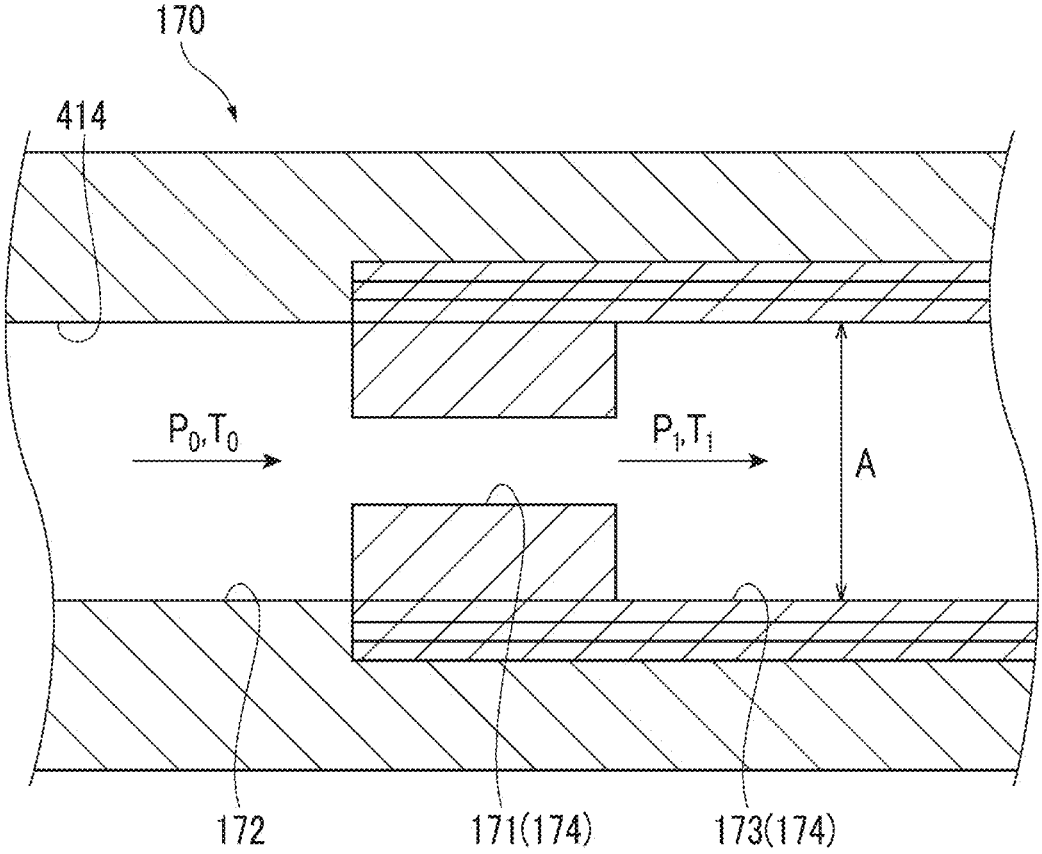
FIG. 4 is a detailed cross-sectional view showing a cooling unit of a forming system according to a present embodiment.

FIG. 4 is a detailed cross-sectional view showing a cooling unit of the forming system according to the present embodiment. As shown in FIG. 4, in the cooling unit 170, a cross-sectional area of a section of a part of the flow path 414 with respect to the extending direction is reduced as compared with a cross-sectional area of the other section of the flow path 414 with respect to the extending direction. The nozzle 23 or the nozzle mounting unit 40 has a configuration in which a part of the flow path 414 is reduced as the cooling unit 170, so that the high-temperature gas is cooled. That is, when the high-temperature gas goes from the section where the cross-sectional area of the cooling unit 170 is reduced to the section where the cross-sectional area is expanded again, adiabatic expansion occurs, and the high-temperature gas is cooled. In this case, the cooling unit 170 may be a member separate from the members included in the nozzle 23 and the nozzle mounting unit 40, or may be a member formed continuously without a boundary with the member included in the nozzle 23 and the nozzle mounting unit 40. The cooling unit 170 is, for example, an orifice.

The cooling unit 170 has, for example, an orifice portion 171, an upstream flow path 172, and a downstream flow path 173. The cooling unit 170 is provided with the orifice portion 171 between the upstream flow path 172 and the downstream flow path 173. The orifice portion 171 is a portion of the flow path 414 obtained by reducing the cross-sectional area with respect to the extending direction as compared with the other section. The upstream flow path 172 is provided on the nozzle 23 side from the orifice portion 171 and has a larger cross-sectional area than the orifice portion 171. The downstream flow path 173 is provided on the protected portion 47 side from the orifice portion 171 and has a larger cross-sectional area than the orifice portion 171. The cross-sectional areas of the upstream flow path 172 and the downstream flow path 173 are, for example, the same. When the control device 100 discharges the high-temperature gas from the metal pipe material P, the high-temperature gas is cooled by flowing to the downstream flow path 173 through the orifice portion 171.

The cooling unit 170 is provided in the nozzle 23, for example. In this case, a female screw of which an inner surface is threaded is provided in a section of a part of the flow path 414 in the nozzle 23 from the boundary between the piston 41 and the nozzle 23. An orifice forming member 174 formed as an integral body in which the orifice portion 171 and the downstream flow path 173 are continuously formed without a boundary is engaged with the section of the part. The orifice forming member 174 has, for example, a shape of a hollow male screw. As a result, the cooling unit 170 is provided in the flow path 414. It should be noted that threading to which the orifice forming member 174 can be engaged may be provided in the flow path 414 from the feed port of the nozzle 23. The cooling unit 170 may be provided in the piston 41. In this case, for example, the piston 41 is provided with a thread to which the orifice forming member 174 can be engaged on the feed port side of the nozzle 23.

Method of Cooling High-Temperature Gas

Here, a method in which the cooling unit 170 cools a high-temperature gas will be described in a case where the control device 100 discharges the high-temperature gas from the inside of the metal pipe material P. A pressure of the high-temperature gas inside the metal pipe material P is defined as an upstream pressure $P_0$ (Pa) and the temperature thereof is defined as an upstream temperature $T_0$ (K). Therefore, the pressure of the high-temperature gas inside the metal pipe material P or in the upstream flow path 172 is the upstream pressure $P_0$, and the temperature thereof is the upstream temperature $T_0$ (K). The pressure of the gas at the boundary portion of the orifice portion 171 with the downstream flow path 173 is defined as an orifice pressure $P_1$ (Pa), and the temperature thereof is defined as an orifice temperature $T_1$ (K).

In a case where the high-temperature gas discharged from the metal pipe material P passes through the orifice portion 171 at the maximum speed, the orifice pressure $P_1$ (Pa) becomes a critical pressure $P_c$ (Pa). The orifice temperature $T_1$ at this time is defined as a critical temperature $T_c$. When the orifice pressure is the critical pressure $P_c$, the discharge speed of the high-temperature gas from the nozzle 23 reaches the speed of sound. In this case, when the high-temperature gas passes through the orifice portion 171 to the downstream flow path 173, it can be considered that the high-temperature gas undergoes an adiabatic change. The relational expression between the upstream pressure $P_0$ and the critical pressure $P_c$ (orifice pressure $P_1$) is represented by the following Equation 1.

$$\frac{P_c}{P_0} = \left(\frac{2}{\kappa+1}\right)^{\frac{\kappa}{\kappa-1}} \tag{1}$$

Further, the relational expression between the upstream temperature $T_0$ and the critical temperature $T_c$ (orifice temperature $T_1$) is represented by the following Equation 2.

$$\frac{T_c}{T_0} = \frac{2}{\kappa+1} \tag{2}$$

Here, κ is a specific heat ratio, and when the high-temperature gas is air, for example, κ is about 1.4. At this time, $P_c/P_0$ is about 0.528, and $T_c/T_0$ is about 0.833. That is, an absolute temperature drops by about 17% as the high-temperature gas passes through the orifice portion 171.

It is assumed that the cross-sectional area of the downstream flow path 173 is A ($m^2$). The passing mass flow rate $K_{vc}$ (kg/s) when the orifice portion 171 reaches the critical pressure $P_c$ is represented by the following Equation 3 using a gas constant R, a critical constant $\psi_c$, and the like.

$$M_{vc} = \frac{\psi_c \cdot A \cdot P_0}{\sqrt{R \cdot T_0}} \tag{3}$$

$$R = 287[\mathrm{J/kg \cdot K}]$$

$$\psi_c = \sqrt{\kappa\left(\frac{2}{\kappa+1}\right)^{\frac{\kappa+1}{\kappa-1}}} = 0.685$$

The cross-sectional area A of the downstream flow path 173 is adjusted so that the flow rate is the flow rate required for the gas exhaust while adjusting the passing mass flow rate $M_{vc}$. For example, the cross-sectional area of the orifice portion 171 is preferably about 63% or less of the cross-sectional area A of the downstream flow path 173. This is an area ratio calculated from a flow velocity ratio when $P_c/P_0$ is about 0.528. An area ratio of the cross-sectional area of the orifice portion 171 to the cross-sectional area A of the downstream flow path 173 may be adjusted to a small value according to the exhaust capacity downstream of the orifice portion 171 to limit the passing mass flow rate $M_{vc}$ of the high-temperature gas. Note that even when the orifice pressure $P_1$ becomes larger than the critical pressure $P_c$, the same effect as described above can be obtained. Further, although air is exemplified in the above, the same effect can be obtained with other gases.

Action and Effect of Forming System

Next, the action and effect of the forming system 200 according to the present embodiment will be described.

In the forming system 200 according to the present embodiment, the high-pressure gas is supplied to the heated metal pipe material P by the nozzle 23, the nozzle mounting unit 40, and the pneumatic circuit 44 to expand the metal pipe material P. The high-pressure gas becomes a high-temperature gas due to the heated metal pipe material P. The high-temperature gas is discharged at the discharge portion after expanding the metal pipe material. Here, the forming system 200 includes a cooling unit 170 that cools the gas flowing through the discharge portion. As a result, it is possible to prevent the high-temperature gas from flowing through the flow path 414 in the forming system 200. From the above, the influence of heat on the member around the flow path 414 can be suppressed.

In the forming system 200 according to the present embodiment, the high-pressure gas is supplied to the heated metal pipe material P by the nozzle 23, the nozzle mounting unit 40, and the pneumatic circuit 44 to expand the metal pipe material P. The gas becomes a high-temperature gas due to the heated metal pipe material P. The high-temperature gas flows through the flow path 414 provided in the nozzle 23 (an example of a nozzle) and the piston 41 (an example of a support portion). The cooling unit 170 is disposed so as to cool the flow path 414 at least at a position on the feed port side in the extending direction with respect to the cylinder 42 (an example of the drive unit). Therefore, the high-temperature gas flowing through the flow path 414 is cooled by the cooling unit 170 at least at a position on the feed port side of the nozzle 23 in the extending direction with respect to the cylinder 42. Since at least the range on the feed port side of the nozzle 23 in the extending direction with respect to the cylinder 42 is less susceptible to heat as compared with the cylinder 42 and a range on the side opposite to the feed port side of the nozzle 23 in the extending direction with respect to the cylinder 42, the influence of heat due to the high-temperature gas can be suppressed within this range. Therefore, the influence of heat on the member around the flow path 414 can be suppressed.

Further, in the forming system 200, the cooling unit 170 is formed by reducing a section of a part of the flow path 414. The high-temperature gas flowing through the flow path 414 undergoes an adiabatic change by passing through the cooling unit 170. Therefore, the high-temperature gas is cooled at least at a position on the feed port side of the nozzle 23 in the extending direction with respect to the cylinder 42. Therefore, it is possible to efficiency suppress the influence of heat on the member around the flow path with a simple configuration. Further, by fitting the orifice forming member 174 into the existing flow path 414 as the cooling unit 170, a section of a part of the flow path 414 can be easily reduced and the high-temperature gas can be easily cooled.

Modification Example

The present disclosure is not limited to the above embodiment. For example, the overall configuration of the forming system 200 and the expansion forming apparatus 10 is not limited to that shown in FIG. 1, and can be appropriately changed as long as it does not deviate from the purpose of the disclosure. For example, the overall configuration of the pipe holding mechanism 20 may be provided so as to hold both end portions of the metal pipe material Pin a state in which no inclination is generated, that is, in a state parallel to the right-left direction. The compressed gas may be an inert gas.

The cooling unit 170 may be formed as an integral body formed continuously without a boundary with at least one of the nozzle 23 and the piston 41 instead of a separate member. That is, in at least one of the nozzle 23 and the piston 41, the flow path 414 and the orifice portion 171 may be continuously formed without a boundary. The orifice portion 171 may be fixed inside at least one flow path 414 of the nozzle 23 or the piston 41. In this case, the fixing method does not matter as long as the orifice portion 171 is not detached by the pressure of the high-pressure gas and the heat of the high-temperature gas.

The cooling unit 170 may be provided at the tip of the nozzle 23 or the tip of the piston 41. In this case, the upstream flow path 172 of the cooling unit 170 may not be provided. The cooling unit 170 may be provided at the end of the nozzle 23. In this case, the downstream flow path 173 of the cooling unit 170 may not be provided. The cooling unit 170 may have a shape such as a slit shape or a grid shape that realizes the adiabatic expansion. The cooling unit 170 does not have to be an orifice. In this case, the cooling unit 170 may be a water cooling mechanism provided around the flow path 414 and including a tube for circulating cold water. A plurality of cooling units 170 may be provided at positions on the nozzle 23 side in the extending direction of the flow path 414 with respect to the protected portion 47.

Further, the flow path 414 in the piston 41 does not need to be provided, and a configuration is also acceptable in which the compressed gas is directly supplied to the nozzle 23. In this case, the cooling unit 170 may be provided in the nozzle 23 or the communication tube in order to suppress deterioration of the communication tube and the discharge port of the pneumatic circuit 44.

It should be understood that the invention is not limited to the above-described embodiment, but may be modified into various forms on the basis of the spirit of the invention. Additionally, the modifications are included in the scope of the invention.

What is claimed is:

1. A forming system that expands a heated metal pipe material to form a metal pipe, the system comprising:

a gas supply portion configured to supply a gas to the heated metal pipe material to expand the metal pipe material;

a nozzle including a feed port for supplying the gas;

a discharge portion configured to discharge the gas after expanding the metal pipe material; and a cooling unit configured to cool the gas flowing through the discharge portion and-is provided in the nozzle, wherein the cooling unit includes a reduced section where a cross-sectional area of the cooling unit is reduced and a first expanded section and a second expanded section whose cross-sectional areas are expanded, and the reduced section is provided adjacent to and between the first expanded section and the second expanded section.

2. The forming system according to claim 1, wherein the gas supply portion includes a support portion extending from the nozzle to an opposite side of the feed port to support the nozzle, and a drive unit configured to move the support portion along an extending direction of the support portion, a flow path is formed in the nozzle and the support portion to extend from an end portion of the support portion to the feed port, the flow path being configured to cause the gas from the end portion of the support portion toward the feed port and cause the gas to flow at a high temperature from the metal pipe material toward the discharge portion, the gas supply portion is provided with the cooling unit configured to cool the gas flowing at a high temperature through the flow path, and the cooling unit is provided as a member separate from the nozzle at least at a position on a feed port side in the extending direction of the support portion with respect to the drive unit.

3. The forming system according to claim 2, wherein the support portion includes a piston that holds the nozzle, and the drive unit includes a cylinder that imparts an advancing and retreating movement to the piston.

4. The forming system according to claim 3, wherein the piston includes a head portion that protrudes from the cylinder to an outside of the cylinder, and in which the nozzle is concentrically and fixedly mounted on a tip portion of the head portion, a main body that is stored in the cylinder, and a tubular portion that protrudes from the cylinder to the outside of the cylinder, and in which a pneumatic circuit for supplying the gas to the nozzle and discharging the gas from the nozzle is connected to a tip portion of the tubular portion.

5. The forming system according to claim 4, wherein the head portion, the main body, and the tubular portion each have a substantially cylindrical shape and are concentrically and integrally formed, and the flow path is formed by penetrating a center over an entire length from the head portion to the tip portion of the tubular portion through the main body.

6. The forming system according to claim 5, wherein the head portion has a diameter smaller than the main body, and the tubular portion has a diameter smaller than the main body and the head portion.

7. The forming system according to claim 3, wherein in a case where a position of the piston that comes into contact with the cylinder when the piston is most retracted is set as a first boundary, the cooling unit is provided at least on the feed port side with respect to the first boundary.

8. The forming system according to claim 1, wherein the gas supply portion includes a support portion extending from the nozzle to an opposite side of the feed port to support the nozzle, and a drive unit configured to move the support portion along an extending direction of the support portion, a flow path is formed in the nozzle and the support portion to extend from an end portion of the support portion to the feed port, the flow path being configured to cause the gas to flow at a high pressure from the end portion of the support portion toward the feed port and cause the gas to flow from the metal pipe material toward the discharge portion, the gas supply portion is provided with the cooling unit configured to cool the gas flowing through the flow path, and the cooling unit is provided at least at a position on a feed port side in the extending direction of the support portion with respect to the drive unit, and is configured to cool the gas by reducing a cross-sectional area of a section of a part of the flow path with respect to the extending direction of the support portion as compared with a cross-sectional area of the other section of the flow path with respect to the extending direction of the support portion.

9. The forming system according to claim 8, wherein the cooling unit includes an upstream flow path, a downstream flow path, and an orifice portion provided between the upstream flow path and the downstream flow path, and the orifice portion is a portion obtained by reducing a cross-sectional area with respect to the extending direction of the support portion as compared with a cross-sectional area of the upstream flow path and a cross-sectional area of the downstream flow path.

10. The forming system according to claim 9, wherein the orifice portion and the downstream flow path are continuously and integrally formed to form an orifice forming member, and the orifice forming member has a substantially hollow male screw shape.

11. The forming system according to claim 10, wherein the cooling unit is provided on the nozzle, and a female screw is provided in a section of a part of the flow path in the nozzle from a boundary between the support portion and the nozzle, and the orifice forming member is engaged with the female screw.

12. The forming system according to claim 10, wherein the cooling unit is provided on the support portion, and a female screw is provided on the feed port side in the support portion, and the orifice forming member is engaged with the female screw.

* * * * *